United States Patent [19]

Guerét

[11] Patent Number: 4,485,807

[45] Date of Patent: Dec. 4, 1984

[54] APPLICATOR FOR MASSAGING THE CUTANEOUS COVERING

[75] Inventor: Jean-Louis H. Guerét, Paris, France

[73] Assignee: L'Oreal, Paris, France

[21] Appl. No.: 378,607

[22] Filed: May 17, 1982

[30] Foreign Application Priority Data

May 27, 1981 [FR] France ..... 81 10584
May 3, 1982 [FR] France ..... 82 07654

[51] Int. Cl.[3] ..... A61H 9/00
[52] U.S. Cl. ..... 128/66
[58] Field of Search ..... 128/65, 66, 67; 132/115; 401/28, 148, 206, 264, 272, 273; 222/325, 501, 213

[56] References Cited

U.S. PATENT DOCUMENTS 2,448,846 9/1948 Trochim ..... 128/65
2,461,620 2/1949 Wright ..... 222/213 X
2,517,152 8/1950 Wilson ..... 401/28 X
3,256,551 6/1966 Schwartzman ..... 401/264 X
3,587,937 6/1971 Childs ..... 222/213

FOREIGN PATENT DOCUMENTS 272261 of 1969 Fed. Rep. of Germany ..... 401/264
621708 of 1962 France ..... 401/264

*Primary Examiner*—Richard J. Apley
*Assistant Examiner*—David J. Brown
*Attorney, Agent, or Firm*—Cushman, Darby & Cushman

[57] ABSTRACT

A massaging applicator includes a receptacle having one side formed as a foraminous profiled flexible sole for skin massage. Within the receptacle is a dispenser for a liquid product, such as liquid soap, wherein the dispenser has a discharge passage which is automatically opened as the user applies massaging effort to the applicator.

21 Claims, 10 Drawing Figures

APPLICATOR FOR MASSAGING THE CUTANEOUS COVERING

DESCRIPTION

1. Field of the Invention

The present invention relates to an applicator which may be used for massaging the cutaneous covering.

2. Background of the Invention

There are various known massaging instruments for manual use which may be utilised for creating a localised hyperaemia in the regions of the skin which are subjected to massage. This localised hyperaemia consists of a congestion of the blood due to an activation of the underlying blood circulation and it can promote the penetration of appropriate substances.

It is also known that the massaging may advantageously be effected in the presence of soapy water with a view to ensuring cleaning during the massaging, and effecting exfoliation of the dead skin cells. Thus French Published Patent of Addition Application No. 2,443,242 describes a massage applicator also serving as a soap carrier and consisting of a handle which forms a receptacle within which the tablet of soap is contained and of a sole which obturates the receptacle. The sole is provided with a multiplicity of perforations and comprises reliefs or projecting ribs on its active face intended to exert a massaging action on the cutaneous covering. The user may immerse the applicator in water in order partially to dissolve the tablet of soap arranged within the receptacle and thus to produce soapy water which is applied to the cutaneous covering during the massage. The drawing off of the soap within the receptacle is therefore only effected by placing the tablet of soap into contact with water for a certain period and by its partial temporary dissolution in the water.

However, this has some drawbacks to the extent that one is not certain of obtaining an adequate dissolution of the required quantity of soap because the water penetration within the applicator may not be uniform, and moreover because the soap tablet may have variable solubility characteristics.

In French Published Patent Specification No. 2,457,656, there has already been described an applicator consisting of a flexible sole and a handle forming a receptacle intended to contain a water soluble product, in particular a tablet of soap; the sole is made in the shape of a sleeve capable of turning on rollers so that the drawing off of the soap within the receptacle is effected not only by dissolution on contact with the skin but also by the rubbing of the soap against the applicator sole itself. Such a device resolves the problem posed but it has drawbacks to the extent that it requires the presence of movable components which may present difficulties in manufacture and use.

A brush for massaging the scalp and the skin by means of products with a pasty consistency is also known from French Patent Specification No. 1,147,689 (Hebrock). This brush comprises a sole carrying bristles of which one, which is disposed in the centre of the sole, is hollow and is connected to a preferably detachable container intended to accommodate the massaging agent and to form the brush handle. When one presses on the handle whilst using the brush, the massaging agent can emerge in a minimal quantity via the hollow bristle. Although this device is suitable for dispensing products with a very pasty consistency, it is not at all suitable to accommodate liquid massaging agents.

SUMMARY OF THE INVENTION

The object of the present invention is to overcome these known drawbacks and to provide an applicator for massaging the cutaneous covering, which applicator may allow a uniform distribution of a soap solution on a flexible sole and which should be of a simple, economic design, with easy handling and security from breakdowns.

Another object of the invention is to provide such an applicator which would also allow liquid products other than a soapy solution to be dispensed and distributed.

The present invention therefore provides an applicator which may be used for massaging the cutaneous covering, consisting of a receptacle within which is mounted a dispenser for the liquid product and which is capable of being closed by a flexible sole provided with continuous or discontinuous reliefs and perforations, the liquid product dispenser being provided with at least one passage which is capable, when open, of letting the liquid product pass outwardly through the perforations of the sole and having a side which is at least partly deformable and which can be manually acted on by the user to cause the liquid product to emerge through the perforations of the sole. The passage(s) intended for the liquid should be normally obturated and opened by the manual action of the user producing the emergence of the said liquid product.

In a first embodiment of the applicator according to the present invention, a dispenser passage is formed by a slit or a hole cut into a deformable nipple which is normally closed and is capable of opening up when an internal high pressure is established within the dispenser. Preferably, the dispenser comprises an air inlet valve allowing the pressure equilibrium to be reestablished after emergence of the liquid product. The means for opening the dispenser passage consist of a totally or partially deformable dispenser surface, this surface being capable of being manually actuated by the user (either directly—if a part of the surface passes beyond the receptacle or is able to be acted on from outside the receptacle—or indirectly via the surface itself of the receptacle—if the receptacle is made in a deformable manner). Thus, by way of example, the dispenser may comprise a bellows-shaped surface.

Preferably, the receptacle contains internally an accommodation for the dispenser, means being provided for facilitating dismantling with a view to exchanging the dispenser.

The accommodation may for instance be formed by a kind of cup defined within the receptacle, for example by being carried by radial arms which are substantially parallel to the flexible sole, the dispenser being capable of being introduced into the housing and if necessary being integrated with the latter, for instance by screwing.

Preferably, the applicator can comprise an open, relatively rigid support behind the flexible sole, preventing undue deformation of the flexible sole under the effect of the manual force applied to the applicator during the massage. This support, which may comprise radial interconnected arms for instance arranged in pairs, may be advantageously moulded integrally with a peripheral skirt capable of being screwed into the receptacle body and preferably carrying the dispenser housing by means of other radial arms; this skirt may have on its base an outer flange ensuring the tight hold of the sole as well as of the open support which comes to be placed behind the sole.

Preferably, the or each opening of the dispenser is orientated directly towards the inner side of the flexible sole.

In a second embodiment of the applicator according to the present invention, a poppet valve is disposed on at least one above mentioned dispenser passage which is normally closed but is capable of opening to cause the liquid product to pass outwardly under the combined effect of the user's manual action on the dispenser and of the deformation of the flexible sole during the massage.

According to a convenient characteristic of the applicator in accordance with this second embodiment, the dispenser consists of a bottle whose neck is obturated by a stopper supporting a poppet valve by its bottom, the said bottle being capable of coming to be located directly in an inverted position within the container, via an opening arranged in the latter, on the opposite side from that which is obturated by the flexible sole.

In this way, dispensers may be made in the form of refills containing liquid products of different kinds capable of being applied on the skin as the skin is being subjected to a massaging action. Examples of these liquid products include, apart from the liquid soaps already referred to above: exfoliating solutions, solutions of tonic products, moisturising products, emollient products and, in general, all products having a cosmetic action.

The means intended to support the dispenser within the receptacle are advantageously formed by a ring—or ring segments which are regularly distributed over a circle—abutted by the dispenser introduced by its neck, this ring, or these ring segments, being carried by a multiplicity of strips extending radially towards the sole of the applicator. This support may be formed, by way of example, by six strips interconnected in pairs at their tops, by three ring segments.

According to a first variant of the embodiment of this dispenser support, the strips are made integrally with a peripheral skirt capable of being screwed into the body of the receptacle and carrying an external flange for clamping the flexible sole against the opening of the receptacle, as has been indicated above with reference to the first variant of the embodiment. Moreover, the said peripheral skirt may, as has also been indicated above, be made integrally with an open support intended to come to bear against the internal side of the flexible sole so as to prevent its sagging following prolonged use.

According to a second variant of the embodiment of this dispenser support the strips forming it are connected, at their ends which do not support the dispenser, by a ring (possibly by ring segments), the said support then forming an independent component placed within the receptacle; in the case where provision is made for a skirt carrying an open support reinforcing the sole, the dispenser support bears against the periphery of the said skirt.

Moreover, according to a first variant of the embodiment of the strips composing the inner dispenser support, advantageously in the case where the support takes the shape of an independent element, the strips are flexible. The dispenser then abuts the ring or the ring segments and bears against the flexible strips. In use, the user takes the receptacle with the palm of his hand enclosing the dispenser bottom, which is made in such a way that when the dispenser is positioned in the receptacle ready for use it is approximately level with the edge of the receptacle or else it slightly projects from the latter.

According to a second variant of the embodiment of the strips, the strips are rigid, in which case, provision is preferably made for means for fixing the dispenser within the receptacle. These fixing means may, for example, consist of an annular rib formed on the side wall of the dispenser near its bottom surface, this rib being capable of being introduced in a corresponding groove arranged in the top opening of the receptacle. When the dispenser is thus positioned in the receptacle, its bottom is level with the corresponding surface of the receptacle; provision is advantageously made for this bottom of the dispenser to be extended externally along a flange which, when the dispenser is fixed within the receptacle, covers the free edge of the receptacle which makes it possible to withdraw the dispenser easily after use.

The dispenser advantageously has a bellows-shaped surface both in the case where the dispenser is not fixed within the receptacle at the time of use but only bears on the flexible strips, and in the case where the dispenser is fixed within the receptacle at the time of use. However, in this latter case, provision should be made for a relatively pliable dispenser bottom surface to make it possible to press on it.

As has already been indicated above, the arrangement is made in such a way that the liquid massaging product should only be delivered following a concerted action, on the one hand by deforming the dispenser surface by pressure exerted by the user on its bottom and, on the other hand, by the deformation of the flexible sole during the massage.

The dispenser according to this second embodiment of the invention, which is of a simpler structure, is easy to use in the case where the user wishes to perform massage with the help of different solutions. In fact an applicator according to the first embodiment may be considered to be difficult to use—even in the case where the membrane carrying the slit nipple is an integral part of the dispenser—if, whilst a liquid soap dispenser still containing some of a first liquid product is in position within the receptacle, one wishes to use a different product (for instance, an exfoliative solution). The user must then dismantle the applicator by unscrewing the skirt carrying the inner cylindrical housing and this entails a loss of time, especially if the user frequently changes the massaging product.

BRIEF DESCRIPTION OF THE INVENTION

In order that the present invention may more readily be understood, there will now be described two embodiments represented in the accompanying drawings, by way of purely illustrative and non-restrictive examples. In these drawings.

DESCRIPTION OF THE PREFERRED EMBODIMENTS

Figure 1:
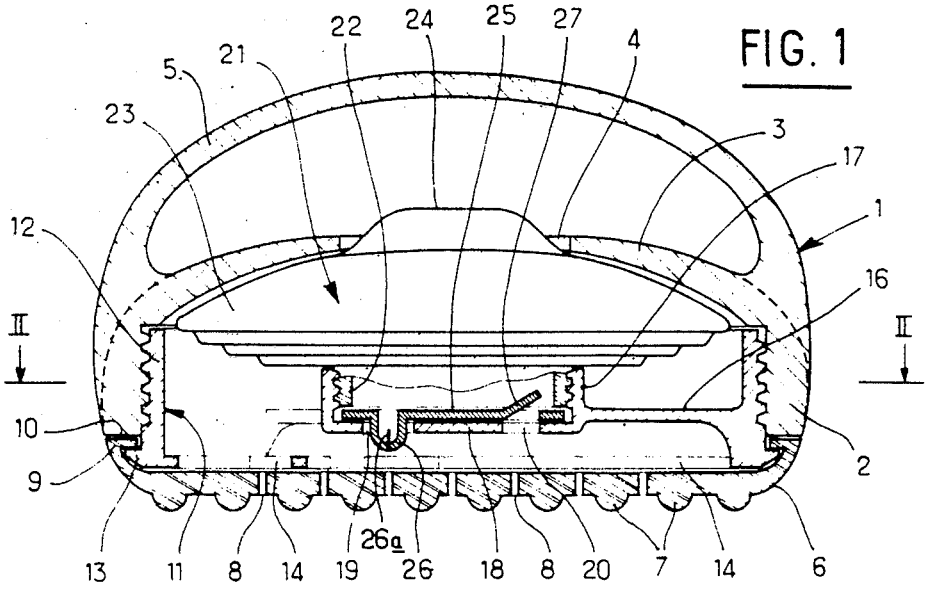
FIG. 1 is an axial cross-sectional view of a first embodiment of an applicator according to the invention.

The applicator, shown in FIG. 1, which may be used for massaging the cutaneous covering comprises a receptacle 1 having an axis of symmetry which is vertical in FIG. 1, and having an internally threaded side wall 2, a bottom 3 provided with a central opening 4, and a handle 5 extending diametrically above the bottom 3 at a sufficient distance to allow the user's fingers or hand to be inserted between the bottom 3 and the handle 5. The side of the applicator on the side opposite to bottom 3, may be obturated by a flexible sole 6 made of a moulded rubber material having a plurality of reliefs, mouldings, stumps or other formations 7, disposed in any suitable manner, as well as a plurality of openings or through perforations 8 providing communication for fluid, and in particular liquid, between the inside of the receptacle and the outside. The flexible sole has a circular peripheral edge 9 which is capable of being clamped against the corresponding peripheral face 10 of the side wall 2 under the tightening effect of an inner component 11.

The inner component 11 has an externally threaded cylindrical outer skirt 12 capable of being screwed into the internal thread of side wall 2. At the base of skirt 12 is an external flange 13 which presses upwardly under the edge 9 to clamp the edge 9 against the edge 10 of side wall 2. Within the base of skirt 11, the open support for the flexible sole 6 is constituted by a plurality of generally radial arms 14 joined in pairs by segments 15 made of a plastic material. For example, the applicator comprises six radial arms connected by three segments; but provision may also be advantageously made for a ring connecting the ends of all the radial arms instead of the discontinuous segments 15.

Above the open support made in this way, the skirt 12 has another three radial arms 16 supporting a central housing comprising an internally threaded cylindrical skirt 17 and a bottom 18 with two openings 19, 20.

Figure 3:
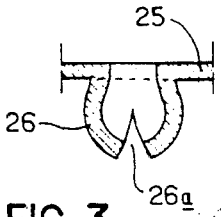
FIG. 3 shows a detail of the split applicator nipple of FIGS. 1 and 2, on an enlarged scale, in the configuration it has when the liquid is emerging.
Figure 2:
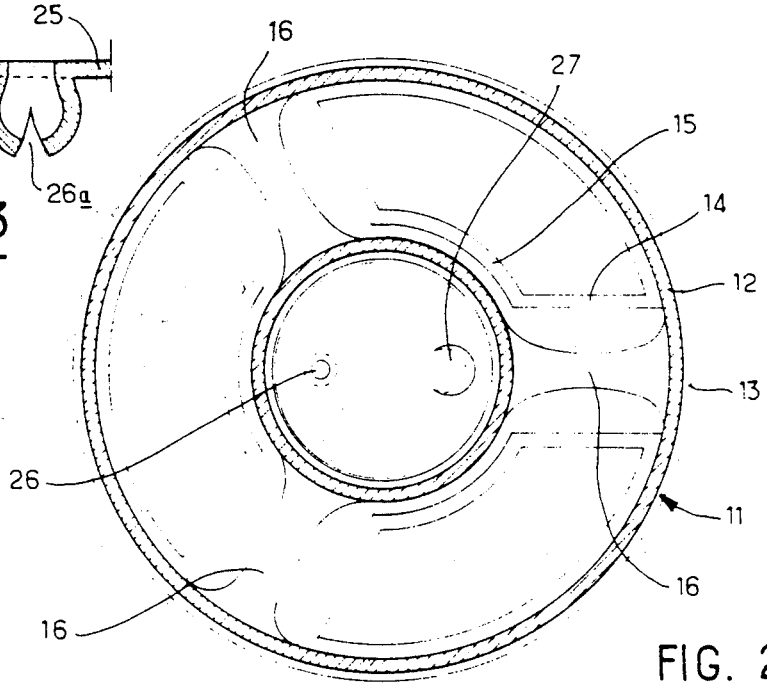
FIG. 2 shows a cross-section along the line II—II of FIG. 1.

The receptacle formed in this way can accommodate a liquid soap dispenser 21 having a cylindrical side wall 22 with an outer thread corresponding to the thread of skirt 17 and with a bellows-shaped top part 23 whose bottom 24 projects towards the outside via opening 4. The dispenser 21 is obturated by an inner membrane 25 made of rubber or another elastomer which has a nipple 26, provided with a slit 26*a*, passing through the opening 19 and has a valve 27 situated opposite opening 20. The nipple is orientated towards the outside of housing 17 and the valve 27 towards the inside so that, while the nipple and valve are normally closed, the nipple will tend to open (FIG. 3) and the valve to remain closed if the contents of dispenser 21 are compressed whereas the nipple will close and the valve will open if the dispenser is expanding.

The device functions in the following manner. Suppose the dispenser 21 to be filled with liquid soap or another liquid product: The user then takes the applicator, holding it by the handle, and performs a massage by applying the flexible sole 6 to the skin. If massage is performed in the presence of water, for instance in a bath, water enters the receptacle via the openings 8. When the user wishes to emit liquid soap, he or she will also press on the bottom 24 and the liquid soap will be emitted via nipple 26 into the receptacle where it is diluted in the water taken in via openings 8. Moreover, as will be seen in the drawing, the dispenser may advantageously be designed in such a way, as to have a large diameter substantially corresponding to the inner diameter of the receptacle; alternatively it may be made in a different way making it possible, when the dispenser is being deformed, to eject simultaneously a portion of the water contained within the receptacle through the openings 8, and possibly release of the dispenser is capable of facilitating the intake via these perforations 8.

At the time when the user relaxes the pressure on bottom 24 the dispenser 21, aided by valve 27, resumes its initial position to allow the pressures to be equalised.

When there is no liquid soap remaining the dispenser may be refilled by unscrewing the skirt 12 in relation to receptacle 1 and extracting component 11, whereupon, the dispenser 21 can be unscrewed from its housing 17. Membrane 25 is kept in position at the bottom of housing 17 by virtue of being separate from the dispenser itself which is then extracted. Dispenser 21 is refilled and the skirt 17 of the component 11 is screwed back on to dispenser 21 so membrane 25 obturates the dispenser. Component 11 is placed into position again within the receptacle 1 by screwing skirt 12 back into the internal thread of side wall 2 so as to clamp the edge 9 of the flexible sole 6 against the side wall 2 of receptacle 1.

Such an applicator may, of course, be capable of many variations. The dispenser could for example be a disposable dispenser and the membrane, such as membrane 25, would then be an integral part of the dispenser. In another variant, the opening 4 could be omitted, the dispenser being entirely contained within the receptacle and the top surface 3 being sufficiently flexible to make it possible to press on the dispenser and to discharge liquid soap, this movement moreover facilitating the ejection of the water and dissolved soap from perforations 8. The component 11 could be shaped in any other way and the device could even be made so that a part of the dispenser would come into contact with a part of the flexible sole 6 so as to open the dispenser passage or passages by the deformation of the sole under the effect of the massage.

Figure 4:
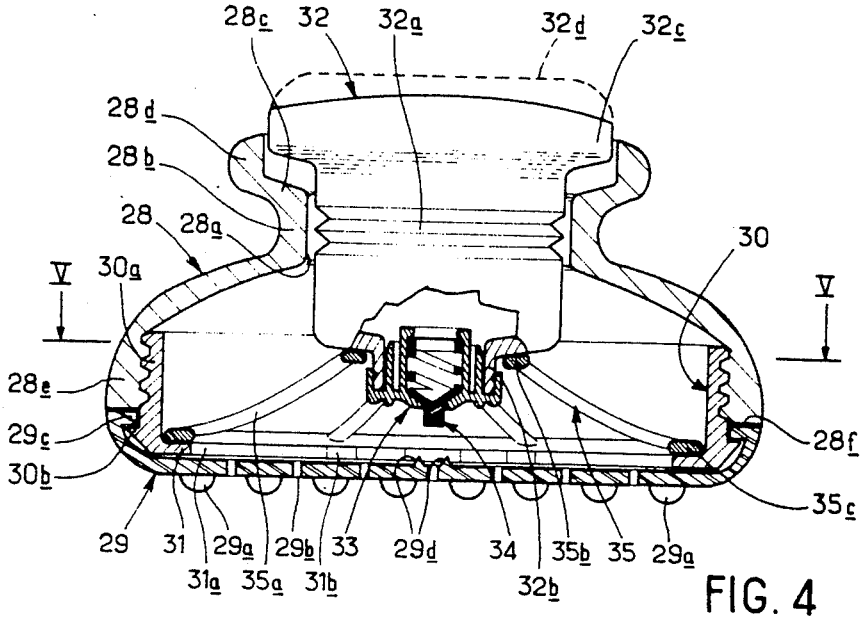
FIG. 4 is an axial cross-sectional view of a second embodiment of an applicator in accordance with the invention, the dispenser being shown in the configuration it has when it is introduced into the receptacle of the applicator, the cross-section being taken along the line IV—IV of FIG. 5.

The applicator for massaging the cutaneous covering, which has been represented in FIG. 4, comprises a substantially cup-shaped receptacle 28, with symmetry of revolution, whose open bottom 28*a* is continued by a substantially cylindrical wall 28*b* which then flares into its part 28*c* to become substantially cylindrical again at 28*d*. The bottom of the receptacle thus forms a handle allowing the device to be easily held. Moreover, the side wall 28*e* of receptacle 28 is provided with an internal thread near its free opening.

The free opening is obturated by a flexible sole 29 made of a moulded rubber material having a plurality of reliefs, mouldings, stumps or other formations 29a as well as a plurality of openings or through perforations 29b providing liquid intercommunication between the inside of receptacle 28 and the outside. The flexible sole has a circular peripheral edge 29c which is capable of being clamped against the corresponding peripheral surface 28f of the side wall 28e under the tightening action of an internal component 30.

The internal component 30 has an externally threaded cylindrical skirt 30a capable of being screwed into the internal thread of side wall 28e. The base of skirt 30a has an external flange 30b which, when it comes to bear under edge 29c ensures the tight hold of the edge 29c against edge 28f of the receptacle 28.

The applicator comprises, behind the flexible sole 29, an open support 31 made of a relatively rigid plastic material preventing undue deformation of sole 29 under the effect of the manual force applied on to the applicator during the massage. This support 31, which may be seen in FIG. 5 in particular, is moulded integrally with the peripheral skirt 30a and is formed by radial arms 31a which, in the example shown, are twelve in number and are interconnected in pairs by segments 31b. This open support could, of course, have different shapes without any difficulty.

Within the receptacle formed in this way, there may be accommodated a dispenser 32 for liquid products, consisting of a cylindrical bottle made of a flexible material such as polyethylene whose side wall has a central bellows-shaped region 32a and whose neck 32b is capable of being obturated by a stopper 33 which will be described below. Moreover, the bottle 32 has an enlarged base 32c which, in the position when the bottle is inverted and introduced into the receptacle 28, comes to occupy the space delimited by the walls, 28c and 28d of receptacle 28, the bellows zone 32a being substantially opposite wall 28b of the receptacle 28.

The dispenser 32 may if required comprise a detachable bottom 32d, shown in dashed lines in FIG. 4, which may for instance be capable of being screwed on to the dispenser barrel and allowing the barrel to be refilled with a liquid product.

Figure 6:
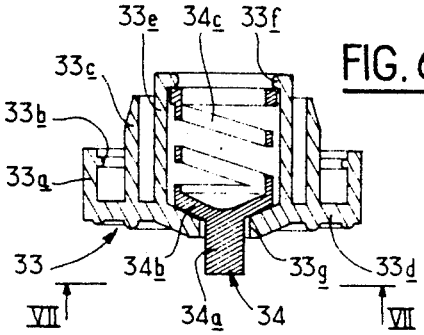
FIG. 6 is an axial cross-section, on an enlarged scale, of the applicator stopper carrying the poppet valve.

The stopper is shown in greater detail in FIG. 6. It comprises, on the one hand, an outer skirt 33a having an internal annular rib 33b near its free end and, on the other hand, an inner skirt 33c spaced therefrom to allow the neck 32b of dispenser 32 to be disposed between the outer and inner skirts 33a and 33c, the rib 33b cooperating with a corresponding groove provided in neck 32b. Moreover, the bottom 33d of stopper 33 carries, concentrically with skirts 33a and 33c, and within skirt 33c, a cylindrical housing 33e forming the seat of a poppet valve.

Figure 7:
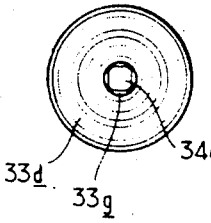
FIG. 7 is a view, taken from below, of the stopper of FIG. 6 along the line VII—VII of FIG. 6.

The bottom 33d of the stopper 33 has a central perforation 33g slidably receiving the stem 34a of valve poppet 34. This stem 34a has a section of octogonal shape (FIG. 7) having four larger equal sides alternating with four equal smaller sides with which the stem 34a bears against an opening 33g. Stem 34a is extended within stopper 33 by a conical valve head surface 34b which, in the closed position of the valve, engages a correspondingly shaped surface formed in the bottom 33d of the stopper 33 and which is biased into this position by a coil spring 34c set against the cylindrical wall 33e and extending from the outer free edge of valve head surface 34b to an inner annular retaining rim 33f formed at the end of wall 33e.

Figure 8:
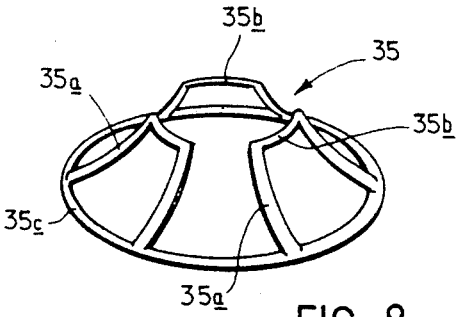
FIG. 8 is a perspective view of the inner dispenser support.

The dispenser 32 provided with its poppet valve, is capable of being accommodated in an inverted position in receptacle 28 on a support 35 which may be seen in greater detail in FIG. 8.

This support 35 is formed by six evenly radially distributed upwardly and inwardly sloping strips 35a, these strips being connected in pairs at their inner ends by respective ring segments 35b and being interconnected at their outer ends by a continuous ring 35c. Thus support 35 forms an independent component which is introduced into receptacle 28 with ring 35c abutting the periphery of skirt 30a and the ring segments 35b forming a seat for the neck 32b of the dispenser 32 which will then be supported on these ring segments 35b.

Figure 5:
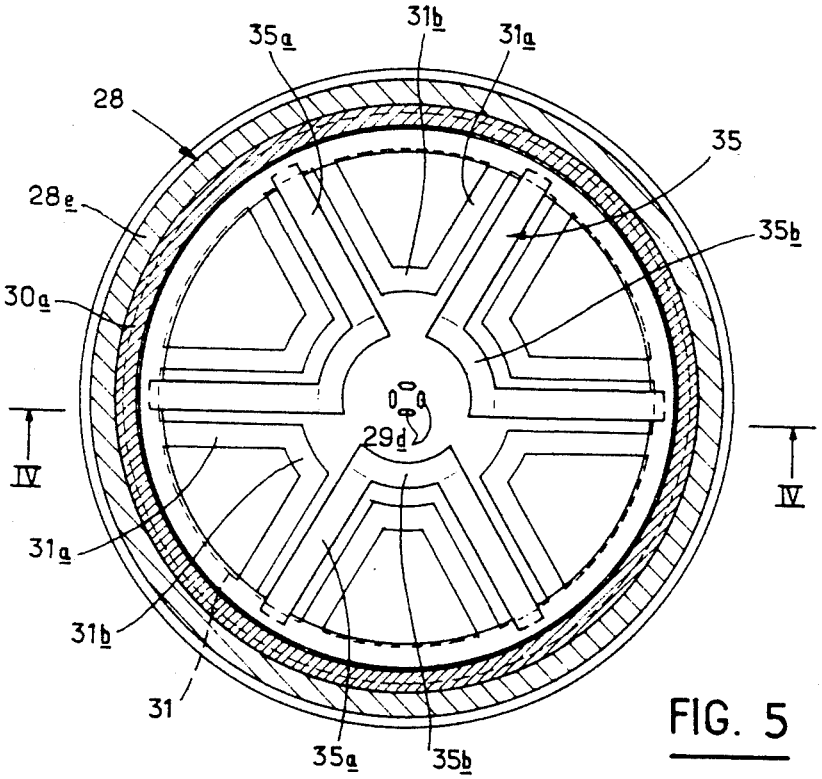
FIG. 5 is a cross-section along the line V—V of FIG. 4, the dispenser being assumed to have been removed.

In FIG. 5, for reasons of clarity in the drawing, the strips 35a have been shown as evenly set off in relation to the arms 31a of the open support 31 for the sole 29. In practice, support 35 is installed in receptacle 28 without worrying about the relative position of the strips 35a and of arms 31a.

Figure 9:
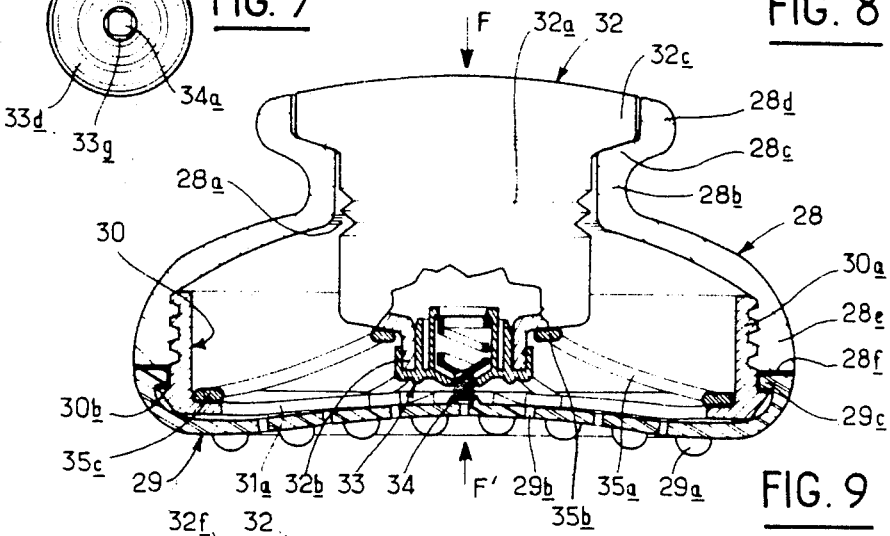
FIG. 9 is a view similar to that of FIG. 4, the device being shown during use.

In the case of FIGS. 4 and 9, the strips 35a are flexible. The device functions in the following way: Suppose the dispenser 32 to be filled with liquid soap or another liquid product and to have its poppet valve 33 attached: The user first inverts it and introduces it in this position into the opening provided in the bottom of receptacle 28 (FIG. 4). Under the effect of the weight, the strips 35a sag to arrive in a position, not shown, wherein the poppet valve does not yet open if the user presses on the bottom of dispenser 32. Nor does this opening occur if the user is content to perform the massage producing the deformation of sole 29 without pressing on the bottom of dispenser 32. For the massaging liquid to be delivered, it is necessary to apply pressure with the palm of the hand on the bottom of the dispenser simultaneously with deformation of the sole by the massage effect, these actions being represented on FIG. 9 by arrows F and F' respectively. It is only then that the stem 34a of the poppet 34 may rise under the action of sole 29 so the conical valve head surface 34b detaches itself from its seat to let the liquid pass.

It will be observed that the inner surface of the sole 29 may comprise protruberances 29d whose function is to ensure a guidance for the stem 34a of poppet 34.

Figure 10:
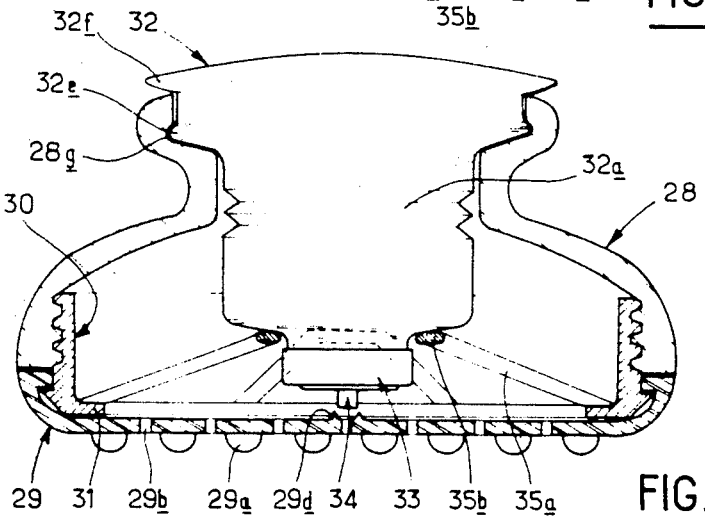
FIG. 10 is an axial cross-section of an applicator which is a variant of the embodiment shown in FIG. 4; the dispenser is shown in position in the receptacle and ready for use.

In the variant shown in FIG. 10, the strips 35a are relatively rigid and are then advantageously made integrally with the skirt 30 and the open support 31 for the sole 29, the respective disposition of the radial arms 31a and of strips 35a then being that of FIG. 5 in which case provision may be made for the dispenser 32 to be fixed in receptacle 28. For this purpose, dispenser 32 has, in the zone of its base 32c, an annular rib 32e which is capable of engaging in a corresponding groove 28g provided in the receptacle 28. Moreover, the bottom of dispenser 32 carries an external flange 32f allowing the dispenser to be withdrawn more easily after use.

In this case, the dispenser bottom must be sufficiently deformable to be capable of producing discharge of the liquid in combination with the deformation of sole 29 during the massage.

With this second embodiment of the applicator according to the invention, the user can have refills of various massaging products at his disposal. These refills, which may each be provided with a stopper 33 with its poppet valve, may be easily interchangeable. When not in use, these refills are protected by covers such as screw caps or clip-on caps.

It shall be understood that the embodiments described above are in no way restrictive and may give rise to any desirable modifications without thereby departing from the scope of the present invention. Thus, particularly in the case of the second embodiment described above, provision could be made for fixing means between the support 35 and the dispenser 32.

I claim:

1. An applicator for massaging the cutaneous covering of a body, comprising (a) an open-ended receptacle;

(b) dispenser means for a liquid product disposed within said receptacle;

(c) a flexible sole closing one end of said receptacle;

(d) means on said flexible sole defining reliefs and perforations;

(e) passage means to said liquid product dispenser means for letting the liquid product pass towards the outside of said dispenser means through said perforations in the sole; and (f) a surface of said dispenser means which is at least partly deformable and capable of being manually acted on by the user to produce discharge of a said liquid product through the perforations of the sole;

the improvement wherein said passage means for the liquid product are normally obturated and wherein means manually operated by the user are provided to produce said discharge of the liquid product, said passage means of the dispenser means including a normally closed poppet valve which is capable of opening to let the liquid product pass outwardly of the dispenser means under the combined effect of the users manual action on the dispenser means and of the deformation of the sole during the massage, said applicator further including support means within the receptacle for supporting the dispenser means, said support means for supporting the dispenser means within the receptacle including (a) ring means, constructed as one of: a ring and ring segments which are regularly distributed over a circle, against which ring means the dispenser means abuts when it is introduced by its neck, and (b) a plurality of strips extending radially inwardly away from the flexible sole of the applicator to carry said ring means spaced from said flexible sole.

2. An applicator according to claim 1, wherein said support means constitutes an independent component placed within the receptacle, and includes further ring means connecting the strips at their ends which do not support the dispenser means.

3. An applicator according to claim 1, wherein said strips are flexible, and the dispenser means, when introduced into the receptacle, bears on the strips.

4. An applicator according to claim 1, wherein the strips are rigid, and including means for fixing the dispenser means within the receptacle.

5. An applicator according to claim 4, wherein said dispenser has a side wall and the receptacle includes a top opening, and wherein said means for fixing the dispenser means consist of an annular rib formed on said side wall of the dispenser means near its bottom, and a corresponding groove arranged in said top opening of the receptacle, said rib and groove being arranged to cooperate with one another by reception of the rib in the groove.

6. An applicator according to claim 5, wherein said dispenser means in position in the receptacle has its bottom flush with the exterior surface of the receptacle, and wherein said bottom of the dispenser means is extended externally along a flange which covers the free edge of the dispenser means when the dispenser means is fixed in the receptacle.

7. An applicator for massaging the cutaneous covering of a body, comprising (a) an open-ended receptacle;

(b) dispenser means for a liquid product disposed within said receptacle;

(c) a flexible sole closing one end of said receptacle;

(d) means on said flexible sole defining reliefs and perforations;

(e) passage means to said liquid product dispenser means for letting the liquid product pass towards the outside of said dispenser means through said perforations in the sole; and (f) a surface of said dispenser means which is at least partly deformable and capable of being manually acted on by the user to produce discharge of a said liquid product through the perforations of the sole;

the improvement wherein said passage means for the liquid product are normally obturated and wherein means manually operated by the user are provided to produce said discharge of the liquid product, said passage means of the dispenser means including a normally closed poppet valve which is capable of opening to let the liquid product pass outwardly of the dispenser means under the combined effect of the user's manual action on the dispenser means and of the deformation of the sole during the massage, said dispenser means comprising a bottle having a neck, a stopper which obturates said neck and a poppet valve supported by said stopper of the bottle, said poppet valve having a seat, a valve stem and a valve heads, wherein the bottom of the stopper carries an internal cylindrical housing constituting said seat of the poppet valve and having means defining a central perforation slidingly receiving the valve stem, said stem being extended in a conical surface of said head which surface, when the valve is in its closed position, abuts said valve seat and wherein spring biasing means are provided to bias the valve head against the valve seat.

8. An applicator according to claim 7, wherein said receptacle includes means defining an opening in a wall remote from said flexible sole for allowing said bottle, in its inverted position, to be placed directly in position in the receptacle.

9. An applicator according to claim 8 wherein the dispenser means has a detachable bottom.

10. An applicator according to claim 8, wherein said poppet valve has a seat, a valve stem and a valve head; wherein the bottom of the stopper carries an internal cylindrical housing constituting said seat of the poppet valve and has means defining a central perforation slidingly receiving the valve stem, said stem being extended in a conical surface of said head, which surface, when the valve is in its closed position, abuts said valve seat and wherein spring biasing means are provided to bias the valve head against the valve seat.

11. An applicator for massaging the cutaneous covering of a body, comprising (a) an open-ended receptacle;

(b) dispenser means for a liquid product disposed within said receptacle;

(c) a flexible sole closing one end of said receptacle;

(d) means on said flexible sole defining reliefs and perforations;

(e) passage means to said liquid product dispenser means for letting the liquid product pass towards the outside of said dispenser means through said perforations in the sole; and (f) a surface of said dispenser means which is at least partly deformable and capable of being manually acted on by the user to produce discharge of a said liquid product through the perforations of the sole;

the improvement wherein said passage means for the liquid product are normally obturated and wherein means manually operated by the user are provided to produce said discharge of the liquid product, said passage means of the dispenser means including a normally closed poppet valve which is capable of opening to let the liquid product pass outwardly of the dispenser means under the combined effect of the user's manual action on the dispenser means and of the deformation of the sole during the massage, said dispenser means comprising a bellows-shaped side wall.

12. An applicator as claimed in claim 11 wherein said dispenser means and passage means comprises a bottle having a neck, a stopper which obturates said neck, and said poppet valve being supported by said stopper of the bottle.

13. An applicator according to claim 12, wherein said receptacle includes means defining an opening in a wall remote from said flexible sole for allowing said bottle, in its inverted position, to be placed directly in position in the receptacle.

14. An applicator for massaging the cutaneous covering of a body, comprising (a) an open-ended receptacle;

(b) dispenser means for a liquid product disposed within said receptacle;

(c) a flexible sole closing one end of said receptacle;

(d) means on said flexible sole defining reliefs and perforations;

(e) passage means to said liquid product dispenser means for letting the liquid product pass towards the outside of said dispenser means through said perforations in the sole; and (f) a surface of said dispenser means which is at least partly deformable and capable of being manually acted on by the user to produce discharge of a said liquid product through the perforations of the sole;

the improvement wherein said passage means for the liquid product are normally obturated and wherein means manually operated by the user are provided to produce said discharge of the liquid product, said passage means of the dispenser means including a normally closed poppet valve which is capable of opening to let the liquid product pass outwardly of the dispenser means under the combined effect of the user's manual action on the dispenser means and of the deformation of the sole during the massage, said applicator including support means within the receptacle for supporting the dispenser means, said support means to support the dispenser means within the receptacle including (a) ring means, constructed as one of a ring and ring segments which are regularly distributed over a circle, against which ring means the dispenser means abuts when it is introduced by its neck, and (b) a plurality of strips extending radially inwardly away from the flexible sole of the applicator to carry said ring means spaced from said flexible sole, said strips being flexible, and the dispenser means, when introduced into the receptacle, bearing on said strips, said dispenser means comprising a bellows-shaped side wall and a relatively deformable bottom wall.

15. An applicator according to claim 14 wherein said dispenser means comprises a bottle having a neck, a stopper which obturates said neck, and said poppet valve supported by said stopper of the bottle.

16. An applicator according to claim 14 wherein said receptacle includes means defining an opening in a wall remote from said flexible sole for allowing said bottle, in its inverted position, to be placed directly in position in the receptacle.

17. An applicator for massaging the cutaneous covering of a body, comprising (a) an open-ended receptacle;

(b) dispenser means for a liquid product disposed within said receptacle;

(c) a flexible sole closing one end of said receptacle;

(d) means on said flexible sole defining reliefs and perforations;

(e) passage means to said liquid product dispenser means for letting the liquid product pass towards the outside of said dispenser means through said perforations in the sole; and (f) a surface of said dispenser means which is at least partly deformable and capable of being manually acted on by the user to produce discharge of a said liquid product through the perforations of the sole;

the improvement wherein said passage means for the liquid product are normally obturated and wherein means manually operated by the user are provided to produce said discharge of the liquid product, said passage means of the dispenser means including a normally closed poppet valve which is capable of opening to let the liquid product pass outwardly of the dispenser means under the combined effect of the user's manual action on the dispenser means and of the deformation of the sole during the massage, said applicator including an open, relatively rigid support to prevent undue deformation of the flexible sole in use of the massaging applicator.

18. An applicator according to claim 17 wherein said at least partly deformable surface of the dispenser means which may be manually acted on by the user, comprises a bottom portion projecting from the receptacle.

19. An applicator according to claim 18, wherein said receptacle includes a panel through which said bottom portion of the dispenser means projects, and the receptacle has a diametrically extending handle above said panel and at a sufficient distance therefrom to allow at least the fingers of the user's hand to be inserted between the panel and the handle to act on the panel of the dispenser means.

20. An applicator according to claim 17, wherein said dispenser means and passage means comprises a bottle having a neck, a stopper which obturates said neck, and said poppet valve being supported by said stopper of the bottle.

21. An applicator according to claim 20, wherein said receptacle includes means defining an opening in a wall remote from said flexible sole for allowing said bottle, in its inverted position, to be placed directly in position in the receptacle.

* * * * *